US008341798B2

(12) United States Patent
Scott, Sr. et al.

(10) Patent No.: US 8,341,798 B2
(45) Date of Patent: Jan. 1, 2013

(54) EXPANDABLE SUPPORTS FOR PAINT ROLLER COVERS

(75) Inventors: John L. Scott, Sr., Wooster, OH (US); Scott A. Melegari, West Salem, OH (US)

(73) Assignee: The Wooster Brush Company, Wooster, OH (US)

( * ) Notice: Subject to any disclaimer, the term of this patent is extended or adjusted under 35 U.S.C. 154(b) by 491 days.

(21) Appl. No.: 12/627,627

(22) Filed: Nov. 30, 2009

(65) Prior Publication Data

US 2010/0139024 A1 Jun. 10, 2010

Related U.S. Application Data

(60) Provisional application No. 61/120,733, filed on Dec. 8, 2008.

(51) Int. Cl.

| | |
|---|---|
| ***B05C 1/00*** | (2006.01) |
| ***B05C 17/02*** | (2006.01) |
| ***B05C 1/08*** | (2006.01) |
| ***B24D 13/14*** | (2006.01) |
| ***B44D 5/00*** | (2006.01) |
| ***B25F 5/02*** | (2006.01) |
| ***A41F 1/00*** | (2006.01) |
| ***A41F 1/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |
| *B42F 1/02* | (2006.01) |

(52) U.S. Cl. ..... 15/230.11; 492/13; 492/19; 24/536

(58) Field of Classification Search ..... 15/230.11, 15/236.03, 230; 492/13, 14, 19, 45, 16, 30, 492/47, 48; 29/895.21, 895.22, 895.23; 24/536, 24/607; 403/109.1, 109.2, 109.5, 226, 228
See application file for complete search history.

(56) References Cited

U.S. PATENT DOCUMENTS

| | | | |
|---|---|---|---|
| 2,669,743 | A | 2/1954 | Coughlan |
| 2,675,605 | A | 4/1954 | Thomas |
| 2,977,671 | A | 4/1961 | Wiegand |

(Continued)

FOREIGN PATENT DOCUMENTS

| | | |
|---|---|---|
| WO | WO 2004/009250 A1 | 1/2004 |

(Continued)

OTHER PUBLICATIONS

PCT/US/2009/066533—International Search Report and Written Opinion of the International Searching Authority mailed Jan. 21, 2010 (enclosed).

*Primary Examiner* — Vanitha Elgart
(74) *Attorney, Agent, or Firm* — Renner, Otto, Boisselle & Sklar, LLP

(57) ABSTRACT

Paint roller support includes a substantially rigid sleeve portion for supporting a roller cover thereon and a plurality of flexible fingers that are engageable by an actuator to cause outer ends of the fingers to flex outwardly. An elastomeric material at least partially covers outer surfaces of the fingers for pressing engagement of the elastomeric material against the inner diameter of a surrounding roller cover during outward flexing of the fingers for securely retaining the roller cover in place on the support.

20 Claims, 4 Drawing Sheets

U.S. PATENT DOCUMENTS

| | | | | | |
|---|---|---|---|---|---|
| 2,987,746 | A | * | 6/1961 | Davis et al. | 15/230.11 |
| 3,060,555 | A | | 10/1962 | Kirshenbaum et al. | |
| 3,201,815 | A | * | 8/1965 | Selby | 15/104.002 |
| 3,335,446 | A | * | 8/1967 | McGinley | 15/230.11 |
| 3,447,184 | A | | 6/1969 | McGinley | |
| 3,711,887 | A | * | 1/1973 | Chapman | 15/230.11 |
| 3,751,748 | A | | 8/1973 | Roe et al. | |
| 3,986,226 | A | * | 10/1976 | Roe et al. | 15/230.11 |
| 4,467,509 | A | | 8/1984 | Dezen | |
| 4,541,140 | A | * | 9/1985 | Allison | 15/230.11 |
| 5,069,431 | A | * | 12/1991 | Kakimoto et al. | 267/141 |
| 5,490,303 | A | * | 2/1996 | Graves | 15/230.11 |
| 5,584,092 | A | * | 12/1996 | Polzin et al. | 15/230.11 |
| 5,598,598 | A | * | 2/1997 | Sorenson | 15/144.4 |
| 5,619,769 | A | * | 4/1997 | Hutt | 15/230.11 |
| 5,979,009 | A | | 11/1999 | Polzin et al. | |
| 6,098,240 | A | * | 8/2000 | Taylor | 15/230.11 |
| 6,101,662 | A | * | 8/2000 | Polzin et al. | 15/230.11 |
| 6,378,158 | B1 | * | 4/2002 | Bukovitz | 15/230.11 |
| 6,405,404 | B2 | * | 6/2002 | Babkowski | 15/230.11 |
| 6,851,155 | B2 | * | 2/2005 | Dove | 15/230.11 |
| 6,941,609 | B2 | * | 9/2005 | Woodruff et al. | 15/230.11 |
| 7,028,365 | B2 | * | 4/2006 | Martin et al. | 15/230.11 |
| 7,654,001 | B2 | * | 2/2010 | Martin et al. | 29/895.2 |
| 7,657,959 | B2 | * | 2/2010 | Smith et al. | 15/230.11 |
| 7,779,527 | B2 | * | 8/2010 | Yudovsky et al. | 29/464 |
| 7,784,142 | B2 | * | 8/2010 | Scott, Sr. | 15/230.11 |
| 8,029,427 | B1 | * | 10/2011 | Troudt | 492/17 |
| 2001/0001778 | A1 | * | 5/2001 | Babkowski | 492/17 |
| 2003/0188395 | A1 | * | 10/2003 | Dove | 15/230.11 |
| 2004/0205921 | A1 | * | 10/2004 | Woodruff et al. | 15/230.11 |
| 2007/0022554 | A1 | * | 2/2007 | Wang | 15/230.11 |
| 2009/0249574 | A1 | * | 10/2009 | Liu | 15/230.11 |
| 2010/0139559 | A1 | * | 6/2010 | Scott et al. | 118/258 |

FOREIGN PATENT DOCUMENTS

| | | | |
|---|---|---|---|
| WO | WO 2009/043162 | A1 | 4/2009 |

* cited by examiner

EXPANDABLE SUPPORTS FOR PAINT ROLLER COVERS

CROSS-REFERENCE TO RELATED APPLICATIONS

This application claims the benefit of U.S. Provisional Application Ser. No. 61/120,733, filed Dec. 8, 2008, the entire disclosure of which is incorporated herein by reference.

FIELD OF THE INVENTION

This invention relates generally to rotatable supports for paint roller covers that include elastomeric portions that are mechanically expandable into engagement with the inner diameter of the roller covers for securely retaining the roller covers in place on the supports.

BACKGROUND OF THE INVENTION

Paint roller cover supports are typically rotatably mounted on a shaft portion of a roller frame, and are adapted to receive a cylindrical roller cover that is designed to hold paint or other coating material (hereafter collectively "paint") for coating a variety of surfaces including but not limited to walls, ceilings, floors, decking and fencing of various compositions and textures.

It is generally known to provide paint roller cover supports that allow for relatively easy insertion and removal of roller covers therefrom and also fairly well retain the roller covers in place on the roller cover supports during use as long as the roller covers have a substantially rigid core.

However, there is an ongoing need for roller cover supports that also provide sufficient gripping force to retain roller covers in place on the roller cover supports without slippage during use regardless of whether the roller covers have substantially rigid cores or whether the roller covers are coreless. For example, in some cases the roller cover cores may not be substantially rigid or the roller covers may simply be attached to a substrate or backing material that provides sufficient stability to the roller covers without the need for a core.

SUMMARY OF THE INVENTION

The paint roller cover supports of the present invention include one or more substantially rigid sleeve portions for supporting the roller covers over a substantial portion of their length and elastomeric portions that are expandable into engagement with the inner diameter of the roller covers to retain the roller covers on the supports regardless of slight variations in the inner diameter of the roller covers, and regardless of whether the roller covers have a substantially rigid core or the roller covers are coreless.

In accordance with one aspect of the invention, the roller cover support includes a substantially rigid sleeve support portion having an outer diameter slightly less than the inner diameter of the roller covers to be supported thereby, a plurality of circumferentially spaced axially extending flexible fingers, and an actuator that is axially movable into and out of engagement with axial outer ends of the fingers to cause the outer ends of the fingers to expand and contract, the fingers having outer surfaces that are at least partially covered by elastomeric material that is pressed against the inner diameter of surrounding roller covers during outward flexing of the fingers for securely retaining the roller covers in place on the support.

In accordance with another aspect of the invention, the actuator has an axially inwardly tapered end portion that is engageable with the axial outer ends of the fingers during axial movement of the actuator toward the fingers to cause the axial outer ends of the fingers to flex outwardly.

In accordance with another aspect of the invention, the outer surface of the tapered actuator end portion has a plurality of axially spaced ribs that are engageable by one or more ribs on undersides of the axial outer ends of the fingers to releasably secure the fingers in different amounts of expansion.

In accordance with another aspect of the invention, a ring of the elastomeric material completely encircles all of the fingers.

In accordance with another aspect of the invention, the flexing of the fingers is progressive over their length with increased distance from fixed inner ends of the fingers, and the ring is tapered inwardly along its length toward the axial outer ends of the fingers, whereby when the fingers are substantially fully expanded, the ring has a substantially cylindrical outer surface over a substantial portion of its length that is pressed against the inner diameter of surrounding roller covers to provide a substantially uniform grip against the inner diameter of the roller covers where contacted by the ring.

In accordance with another aspect of the invention, the outer surfaces of the fingers have aligned circumferential grooves in which the ring is received for locating the ring on the fingers.

In accordance with another aspect of the invention, individual pads of elastomeric material may be attached to the outer surfaces of the fingers.

In accordance with another aspect of the invention, the roller cover support includes axially spaced substantially rigid inboard and outboard sleeve portions each having an outer diameter slightly less than the inner diameter of the roller covers to be supported thereby, the inboard sleeve portion has a plurality of circumferentially spaced flexible fingers extending axially outwardly therefrom, and one of the sleeve portions is axially movable toward and away from the other sleeve portion to cause the axial outer ends of the fingers to expand and contract.

In accordance with another aspect of the invention, the inboard sleeve portion is retained against axial movement on the shaft portion of a paint roller frame, and the outboard sleeve portion is mounted for axial movement along the shaft portion toward and away from the inboard sleeve portion.

In accordance with another aspect of the invention, the outboard sleeve portion has an axially inwardly tapered actuator end portion that is engageable with the axial outer ends of the fingers during axial movement of the outboard sleeve portion toward the inboard sleeve portion to cause the axial outer ends of the fingers to expand.

These and other objects, advantages, features and aspects of the present invention will become apparent as the following description proceeds.

To the accomplishment of the foregoing and related ends, the invention, then, comprises the features hereinafter more fully described and particularly pointed out in the claims, the following description and annexed drawings setting forth in detail certain illustrative embodiments of the invention, these being indicative, however, of but several of the various ways in which the principles of the invention may be employed.

DETAILED DESCRIPTION OF THE INVENTION

Figure 1:
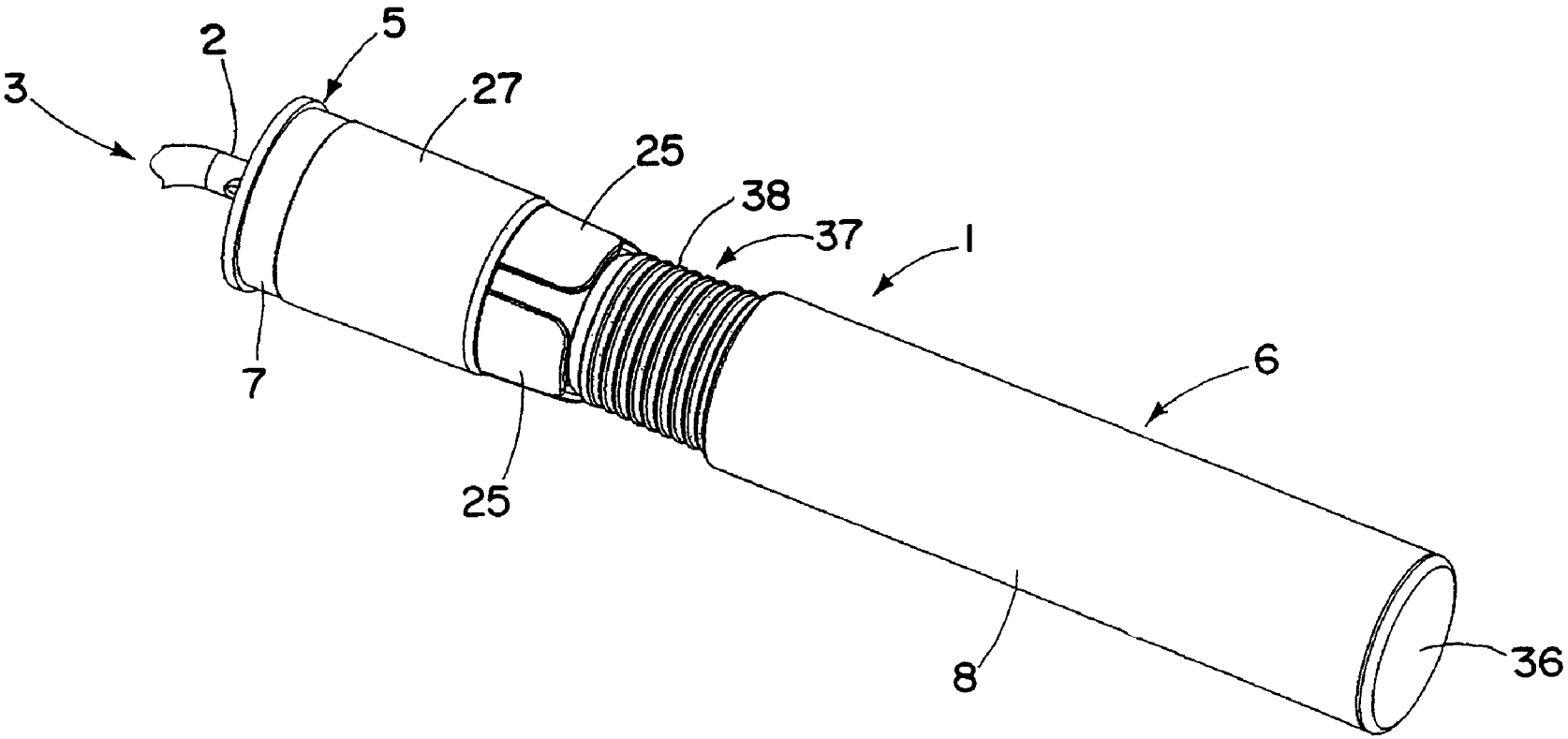
FIG. 1 is a schematic perspective view of one form of expandable roller cover support in accordance with the present invention showing the expandable feature in a contracted position to allow for easy insertion of a roller cover onto the support.
Figure 2:
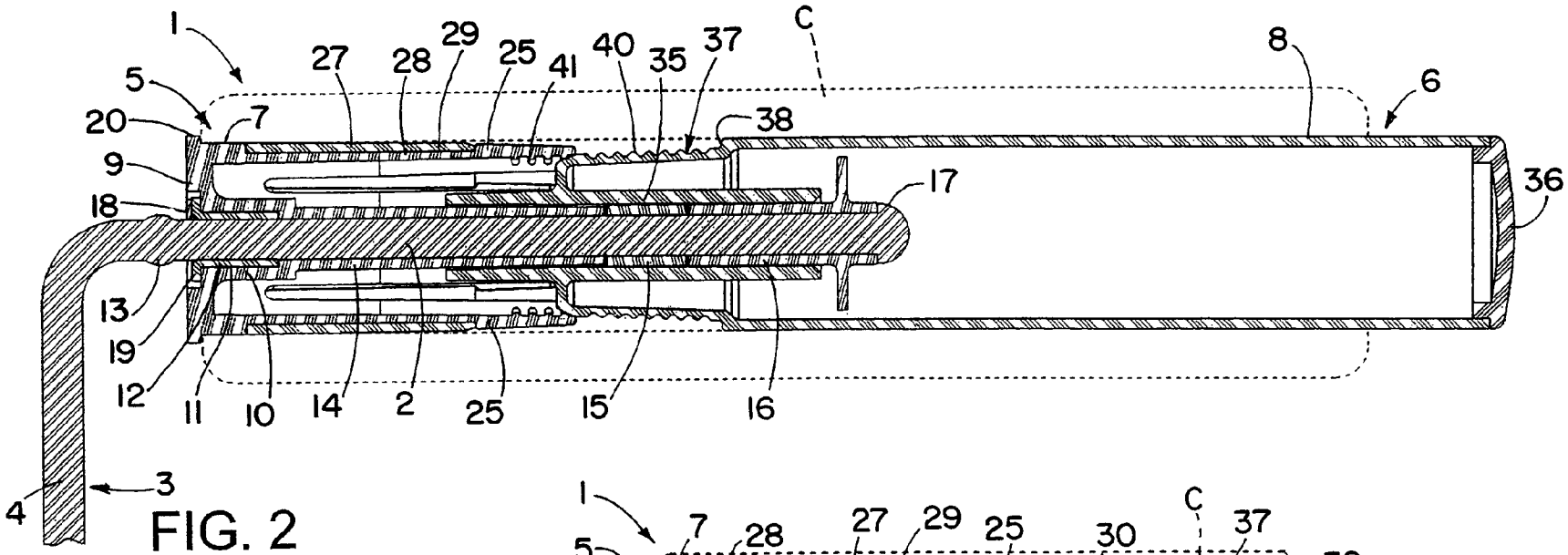
FIG. 2 is a longitudinal section through the expandable roller cover support of FIG. 1 showing a roller cover slidably inserted onto the support.
Figure 3:
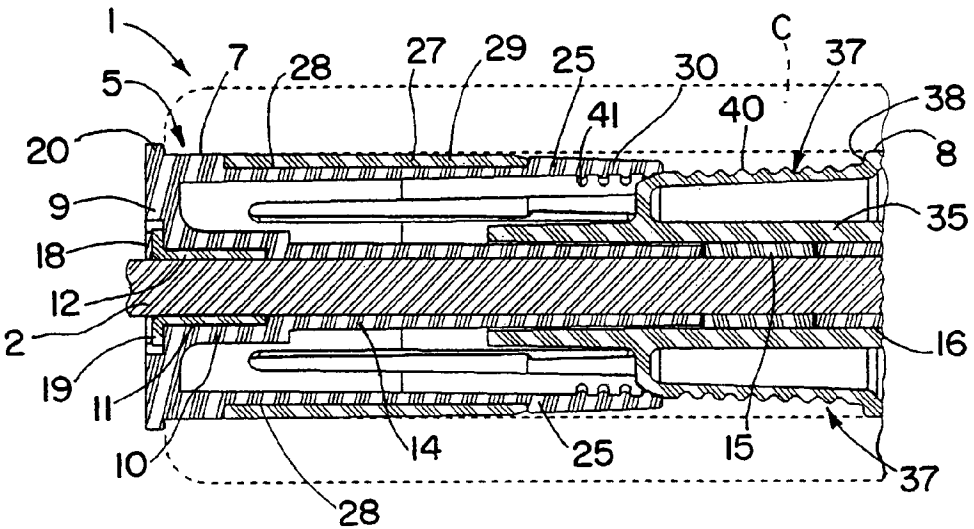
FIG. 3 is an enlarged fragmentary longitudinal section of the expandable feature portion of the expandable roller cover support of FIG. 2 in its contracted position.

Referring now in detail to the drawings, and initially to FIGS. 1-3, there is shown one form of paint roller cover support 1 of the present invention rotatably mounted on a shaft portion 2 of a paint roller frame 3 (only a portion of which is shown). The roller frame may be made from heavy gauge wire or rod bent to shape to provide the shaft portion 2 which may have a right angle bend adjacent the inboard end of the shaft for connection to the handle portion 4.

Roller cover support 1 may be molded out of any suitable plastic material and includes axially spaced inboard and outboard plastic sleeve portions 5 and 6, each having a substantially rigid cylindrical outer wall portion 7 and 8 of a diameter slightly less than the inner diameter of the roller covers to be supported thereby. Inboard sleeve portion 5 may be connected by an end face portion 9 to a central hub portion 10 (see FIGS. 2 and 3) that may have a stepped counterbore 11 for receipt of the shaft portion 2 and an inboard bearing 12 surrounding the shaft portion for rotatably mounting the inboard sleeve portion thereon. Inboard sleeve portion 5 is retained against axial movement on shaft portion 2 as by forming stake-out portions 13 on the shaft portion adjacent the innermost end of the shaft. A tubular extension 14 may be provided on the hub portion to provide greater support for the inboard sleeve portion and to locate a center bearing 15 on the shaft portion between the tubular extension and a tubular spacer 16 that abuts up against an up-ended flange 17 on the outboard end of the shaft. A washer 18 may be disposed between the stake-outs 13 and flange 19 of inboard bearing 12.

Adjacent the axial innermost end of the cylindrical outer wall portion 7 of inboard sleeve portion 5 is an annular stop flange or shoulder 20 for locating a roller cover C on the support when the inboard end of the roller cover is brought into engagement with the shoulder as schematically shown in FIGS. 2 and 3. When thus positioned, the end face portion 9 of inboard sleeve portion 5 provides an end cap for the inboard end of the roller cover.

Extending axially outwardly from the cylindrical outer wall portion 7 of inboard sleeve portion 5 are a plurality of circumferentially spaced flexible plastic fingers 25. Surrounding the radial outer surfaces 26 of the fingers 25 in tight contact therewith is an elastomeric ring 27. Each of the fingers may have an aligned circumferential groove 28 in its outer surface in which the ring 27 is received for locating the ring relative to the fingers. Preferably the ring 27 (and the exterior grooves 28 containing the ring) extends over a substantial portion of the length of the fingers and axially inwardly a short distance beyond the axial inner ends of the fingers as schematically shown in FIGS. 2 and 3. Also the thickness of the axial innermost end of the ring desirably substantially corresponds to the depth of the grooves in the fingers so the innermost end of the ring does not extend radially outwardly beyond the cylindrical outer wall portion 7 of the inboard sleeve portion 5.

The exterior surface 29 of the ring 27 may be smooth, textured, or ribbed and desirably tapers slightly inwardly from its axial innermost end over substantially its entire length. Also, the exterior surface 30 of the fingers 25 that extend axially outwardly beyond the ring desirably taper inwardly to a greater extent than the ring so the ring protrudes radially outwardly beyond the axial outer ends of the fingers.

Figure 4:
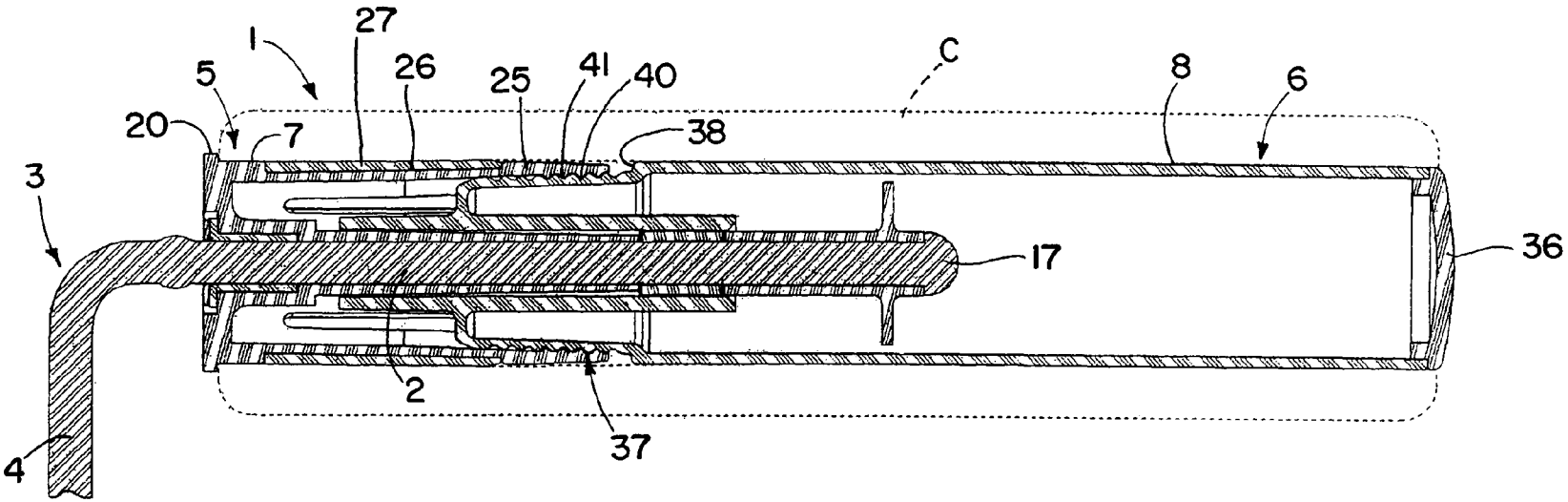
FIG. 4 is a longitudinal section through the expandable roller cover support similar to FIG. 2 but showing the expandable feature in the expanded condition for securely retaining a roller cover in place on the support.

Outboard sleeve portion 6 is both rotatably mounted on the shaft portion 2 and axially movable along the shaft portion toward and away from the fingers 25 as by providing the outboard sleeve portion with a tubular hub portion 35 that is both rotatably supported and axially slidable on the center bearing 15 and tubular spacer 16 surrounding the shaft portion. To accommodate such axial movement of the outboard sleeve portion 6 toward and away from the fingers 25 and still provide the desired support for the roller cover, when the outboard sleeve portion is fully extended and the roller cover C is slid onto the support and up against the shoulder 20 at the innermost end of the inboard sleeve portion 5, the outermost end of the outboard sleeve portion 6 extends a short distance (for example, approximately an inch) beyond the outboard end of the roller cover as schematically shown in FIG. 2. Thus, when the outboard sleeve portion 6 is pushed in substantially to its innermost position, the outermost end of the outboard sleeve portion will be substantially even with the outboard end of the roller cover, and the outboard end of the cover will be substantially closed by an end cap 36 inserted into the outermost end of the outboard sleeve portion 6 as schematically shown in FIG. 4. The outboard end cap 36 provides a convenient surface for the user to push against to move the outboard sleeve portion 6 from the extended position shown in FIG. 2 to the retracted position shown in FIG. 4.

A substantial majority of the length of the outboard sleeve portion 6 is desirably comprised of the substantially rigid outer cylindrical wall portion 8, whereby when a roller cover is properly seated against the shoulder 20 at the innermost end of the inboard sleeve portion 5 and the outboard sleeve portion 6 is pushed axially inwardly, the roller cover is supported over a majority of its length by the cylindrical wall portions 7 and 8 of both sleeve portions 5 and 6 as schematically shown in FIG. 4.

Figure 5:
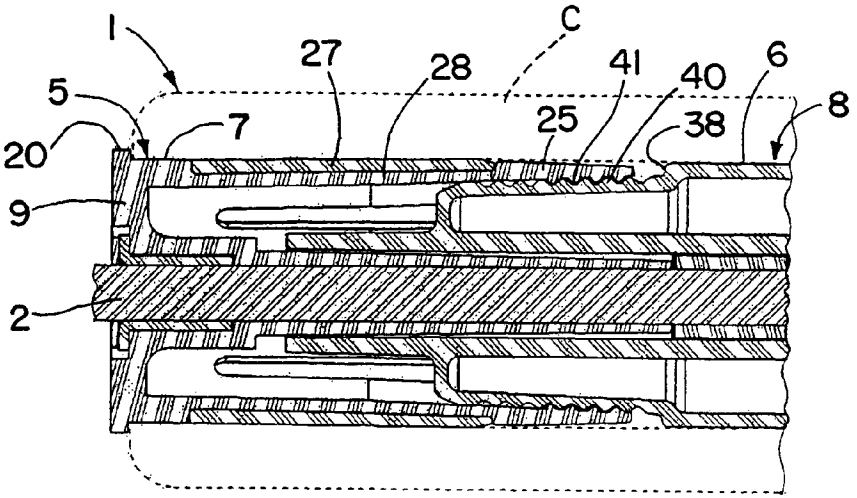
FIG. 5 is an enlarged fragmentary longitudinal section of the expandable feature portion of the expandable roller cover support of FIG. 4 in its expanded condition.

At the axial inner end of the outboard sleeve portion is an axially inwardly tapered actuator 37 that engages the axial outer ends of the fingers 25 during axial inward movement of the outboard sleeve portion, causing the fingers to flex radially outward at an angle to expand the portion of the elastomeric ring 27 overlying the fingers into frictional engagement with the ID of the roller cover. Moreover, because the flexing of the fingers 25 is progressive over their length with increased distance from the axial innermost ends of the fingers, and the ring 27 is tapered inwardly along its length toward the axial outer ends of the fingers, when the fingers are substantially fully flexed outwardly, the ring will have a substantially cylindrical outer diameter over a substantial portion of its length that is slightly greater than the substantially rigid outer cylindrical wall portions of the inboard and outboard sleeve portions 5 and 6 to provide a substantially uniform grip against the inner diameter of the roller cover where contacted by the ring as schematically shown in FIGS. 4 and 5. If the roller cover has a substantially rigid core, the elastomeric ring will be compressed against the ID of the rigid core, whereas if the roller cover has a relatively soft core or is coreless, the elastomeric ring will expand the ID of the roller cover and provide firm frictional contact therewith. In either case, the engagement of the ring 27 with the ID of the roller cover will securely retain the roller cover in place on the support. Also if desired, the outer surface of the ring may be textured or ribbed as aforesaid to increase the frictional contact of the ring with the ID of the roller cover when the ring is expanded.

Axial inward movement of the outboard sleeve portion 6 toward the fingers 25 may be limited as by providing a radial shoulder 38 adjacent the axial outermost end of the tapered actuator 37 that prevents further axial inward movement of the outboard sleeve portion when the outer ends of the fingers butt up against the radial shoulder. Also the fingers 25 and thus the ring 27 surrounding the fingers may be releasably retained in a desired expanded condition as by providing a plurality of concentric annular ribs 40 on the radial outer surface of the actuator end portion 37 that are engageable by one or more ribs 41 on the undersides of the outer ends of the fingers during such axial inward movement of the outboard sleeve portion toward the fingers as schematically shown in FIGS. 4 and 5.

To release the roller cover C from the roller cover support 1 is easily accomplished as by rapping the right angle portion of the roller handle 4 adjacent the roller cover support 1 against the edge of a bucket (with the roller cover support and surrounding roller cover extending into the bucket) to cause the outboard sleeve portion 6 to move axially away from the fingers 25, allowing the fingers and surrounding ring 27 to contract thus freeing the roller cover from the support.

Figure 6:
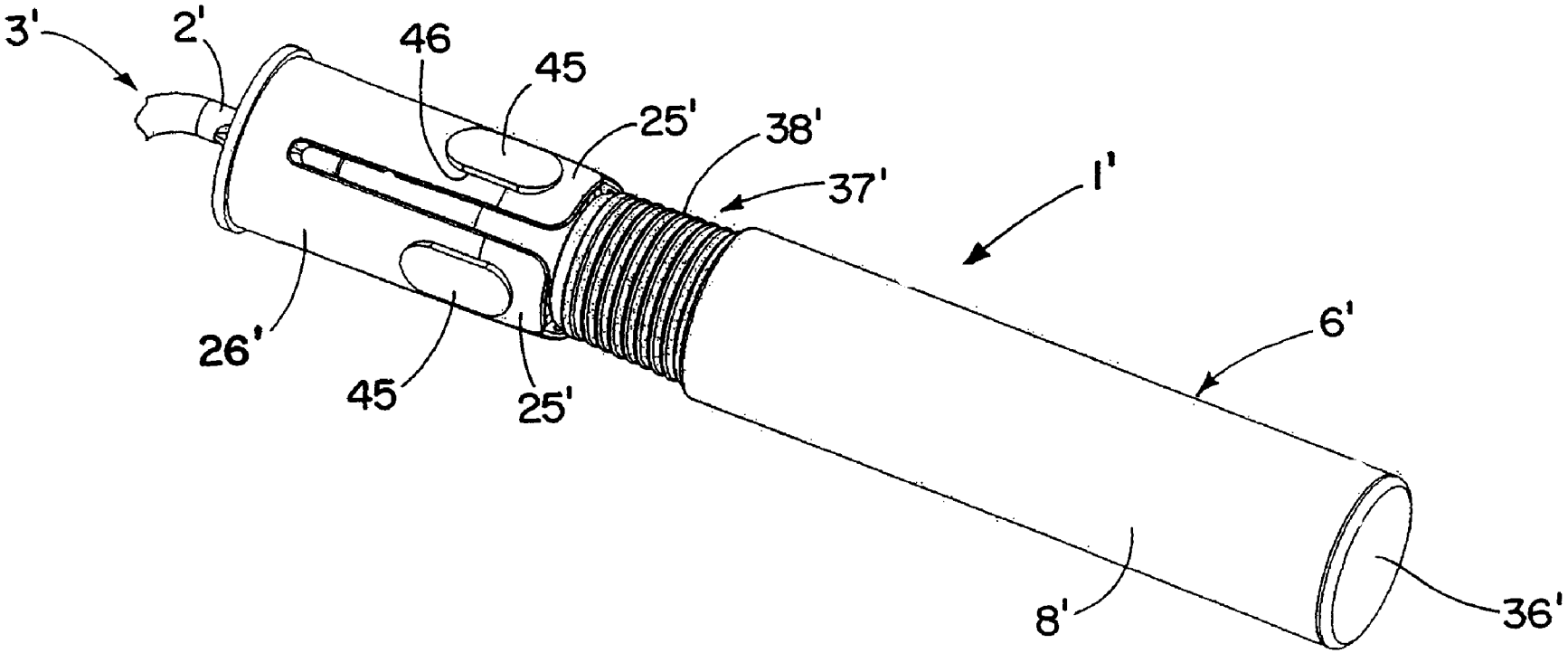
FIG. 6 is a schematic perspective view of another form of expandable roller cover support of the present invention showing the expandable feature in the contracted position to allow for easy insertion of a roller cover onto the support.

FIG. 6 shows another form of paint roller cover support 1' in accordance with this invention which is substantially the same as the roller frame support 1 shown in FIGS. 1-5. Accordingly, the same reference numerals followed by a prime symbol (') are used to designate like parts.

However, instead of the expandable fingers 25' of the roller cover support 1' being surrounded by an elastomeric ring, individual elastomeric pads 45 are attached to recessed areas 46 in the outer surfaces 26' of the fingers. These elastomeric pads are compressibly pressed against the ID of a roller cover inserted onto the roller cover support during outward flexing of the fingers, similar to the elastomeric ring 27 of the FIGS. 1-5 embodiment. Also the pads 45, like the elastomeric ring 27, may be tapered inwardly along their length toward the axial outer ends of the fingers 25' such that when the fingers are substantially fully flexed outwardly, a substantial portion of the length of the exterior surface of the pads will extend outwardly beyond the outer surface of the fingers substantially to the same radial extent to provide a substantially uniform grip against the inner diameter of the roller cover contacted thereby. Otherwise the details of construction and operation of the roller cover support 1' shown in FIG. 6 may be substantially the same as that shown in FIGS. 1-5.

Although the invention has been shown and described with respect to certain embodiments, it is obvious that equivalent alterations and modifications will occur to others skilled in the art upon the reading and understanding of the specification. In particular, with regard to various functions performed by the above-described components, the terms (including any reference to a "means" used to describe such components) are intended to correspond, unless otherwise indicated, to any component which performs the specified function of the described component (e.g., that is functionally equivalent), even though not structurally equivalent to the disclosed component which performs the function in the herein exemplary embodiments of the invention. In addition, while a particular feature of the invention may have been disclosed with respect to only one embodiment, such feature may be combined with one or more other features of other embodiments as may be desired and advantageous for any given or particular application.

What is claimed is:

1. A support for rotatably supporting a paint roller cover on a shaft portion of a paint roller frame, the support comprising at least one sleeve portion rotatably mounted on the shaft portion, the sleeve portion having a substantially cylindrical outer wall portion of a diameter slightly less than an inner diameter of the roller cover to be supported thereby for supporting the inner diameter of the roller cover when inserted thereover, a plurality of circumferentially spaced axially extending flexible fingers rotatably mounted on the shaft portion in axially spaced relation from the sleeve portion, the fingers having axial inner and outer ends, one of the sleeve portion and the fingers being axially movable toward and away from each other to cause the outer ends of the fingers to flex radially outwardly and inwardly relative to the inner ends of the fingers, the fingers having outer surfaces that are at least partially covered by elastomeric material that is pressed radially outwardly into frictional engagement with the inner diameter of a surrounding roller cover during outward flexing of the outer ends of the fingers relative to the inner ends of the fingers for securely retaining the roller cover in place on the support.

2. The support of claim 1 wherein the sleeve portion is mounted for axial movement along the shaft portion toward and away from the outer ends of the fingers.

3. The support of claim 2 wherein the sleeve portion has an axially inwardly tapering end portion at an axial inner end of the cylindrical outer wall portion that is engageable with undersides of the outer ends of the fingers during axial inward movement of the sleeve portion toward the fingers to cause the outer ends of the fingers to flex outwardly.

4. The support of claim 3 wherein the axially inwardly tapering end portion of the sleeve portion has a plurality of concentric annular ribs that are engageable by one or more ribs on the undersides of the outer ends of the fingers to releasably secure the outer ends of the fingers in different amounts of flexing.

5. The support of claim 1 wherein a ring of the elastomeric material surrounds all of the fingers.

6. The support of claim 5 wherein the fingers are made of a flexible plastic material.

7. The support of claim 5 wherein the ring extends over a substantial portion of the length of all of the fingers.

8. The support of claim 7 wherein the flexing of the fingers is progressive over their length with increased distance from the inner ends of the fingers, and the ring has an outer surface that tapers inwardly along its length toward the outer ends of the fingers, whereby when the fingers are flexed outwardly, the outer surface of the ring has a substantially cylindrical outer diameter over a substantial portion of its length to provide a substantially uniform grip against the inner diameter of the roller cover where contacted by the ring.

9. The support of claim 1 wherein individual pads of the elastomeric material are attached to the outer surface of each of the fingers, each of the pads having an outer surface that tapers inwardly along its length toward the axial outer ends of the fingers, whereby when the fingers are substantially fully flexed outwardly, a substantial portion of the length of the outer surface of each of the pads extends outwardly beyond the outer surface of the fingers substantially to the same radial extent to provide a substantially uniform grip against the inner diameter of the roller cover where contacted thereby.

10. A support for rotatably supporting a paint roller cover on a shaft portion of a paint roller frame, the support comprising axially spaced inboard and outboard plastic sleeve portions rotatably mounted on the shaft portion, each of the sleeve portions having a substantially rigid cylindrical outer wall portion of a diameter slightly less than an inner diameter of the roller cover severs to be supported thereby for supporting the inner diameter of the roller cover when inserted thereover, the inboard sleeve portion having a plurality of circumferentially spaced axially outwardly extending flexible plastic fingers, one of the sleeve portions being axially movable toward and away from the other sleeve portion to cause axial outer ends of the fingers to flex radially outwardly and inwardly relative to axial inner ends of the fingers, the fingers having radial outer surfaces that are at least partially covered by an elastomeric material that is pressed radially outwardly into frictional engagement with the inner diameter of a surrounding roller cover during outward flexing of the outer ends of the fingers relative to the inner ends of the fingers for securely retaining the roller cover in place on the support.

11. The support of claim 10 wherein the inboard sleeve portion is retained against both axial inward and outward movement on the shaft portion, and the outboard sleeve portion is mounted for axial movement along the shaft portion toward and away from the inboard sleeve portion.

12. The support of claim 11 wherein the outboard sleeve portion has an axially inwardly tapered end portion at an axial inner end of the cylindrical outer wall portion of the outboard sleeve portion that is engageable with undersides of the axial outer ends of the fingers during axial inward movement of the outboard sleeve portion toward the inboard sleeve portion to cause the axial outer ends of the fingers to flex outwardly.

13. The support of claim 12 wherein an outer surface of the axially inwardly tapered end portion of the outboard sleeve portion has a plurality of concentric annular ribs that are engageable by one or more ribs on the undersides of the axial outer ends of the fingers to releasably secure the outer ends of the fingers in different amounts of flexing.

14. The support of claim 12 wherein a radial shoulder adjacent an axial outer end of the tapered end portion of the outboard sleeve portion is engageable by the axial outer ends of the fingers to limit axial inward movement of the outboard sleeve portion toward the inboard sleeve portion.

15. The support of claim 10 wherein the flexible fingers have axial inner end portions that are integral with an axial outer end portion of the cylindrical outer wall portion of the inboard sleeve portion.

16. The support of claim 11 wherein cooperating stop surfaces on the inboard and outboard sleeve portions limit axial inward movement of the outboard sleeve portion toward the inboard sleeve portion, and additional cooperating stop surfaces on the outboard sleeve portion and on the shaft portion limit axial outward movement of the outboard sleeve portion away from the inboard sleeve portion.

17. The support of claim 10 wherein a ring of the elastomeric material surrounds all of the fingers.

18. The support of claim 17 wherein the flexing of the fingers is progressive over their length with increased distance from the axial inner ends of the fingers, and the ring has an outer surface that tapers inwardly along its length toward the axial outer ends of the fingers, whereby when the fingers are flexed outwardly, the outer surface of the ring has a substantially cylindrical outer diameter over a substantial portion of its length to provide a substantially uniform grip against the inner diameter of the roller cover where contacted by the ring.

19. The support of claim 18 wherein the outer surfaces of the fingers have aligned circumferential grooves in which the ring is received for locating the ring relative to the fingers.

20. The support of claim 10 wherein individual pads of the elastomeric material are attached to the outer surface of each of the fingers, each of the pads having an outer surface that tapers inwardly along its length toward the axial outer ends of the fingers, whereby when the fingers are substantially fully flexed outwardly, a substantial portion of the length of the outer surface of each of the pads extends outwardly beyond the outer surface of the fingers substantially to the same radial extent to provide a substantially uniform grip against the inner diameter of the roller cover where contacted thereby.

* * * * *

UNITED STATES PATENT AND TRADEMARK OFFICE

CERTIFICATE OF CORRECTION

PATENT NO. : 8,341,798 B2
APPLICATION NO. : 12/627627
DATED : January 1, 2013
INVENTOR(S) : John L. Scott, Sr. and Scott A. Melegari It is certified that error appears in the above-identified patent and that said Letters Patent is hereby corrected as shown below:

Column 7, Claim 10
Line 15, "severs" should be deleted.

Signed and Sealed this
Fifth Day of March, 2013

Teresa Stanek Rea
*Acting Director of the United States Patent and Trademark Office*